US006739327B2

(12) United States Patent
Sollami

(10) Patent No.: US 6,739,327 B2
(45) Date of Patent: May 25, 2004

(54) CUTTING TOOL WITH HARDENED TIP HAVING A TAPERED BASE

(75) Inventor: Phillip A. Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 10/330,415

(22) Filed: Dec. 27, 2002

(65) Prior Publication Data

US 2003/0122414 A1 Jul. 3, 2003

Related U.S. Application Data

(60) Provisional application No. 60/345,429, filed on Dec. 31, 2001.

(51) Int. Cl.[7] ..... B28D 5/04

(52) U.S. Cl. ..... 125/36; 125/36; 125/40; 299/79.1; 299/105; 299/110; 299/111; 299/113

(58) Field of Search ..... 125/36, 40; 299/79.1, 299/105, 110, 111, 113

(56) References Cited

U.S. PATENT DOCUMENTS

| | | | | |
|---|---|---|---|---|
| 4,603,911 A | | 8/1986 | Hindmarsh | |
| 4,660,890 A | | 4/1987 | Mills | |
| 4,725,098 A | * | 2/1988 | Beach | 299/79 |
| 4,981,328 A | * | 1/1991 | Stiffler et al. | 299/79 |
| 6,196,636 B1 | | 3/2001 | Mills | |
| 6,199,451 B1 | * | 3/2001 | Sollami | 76/108.2 |
| 6,375,272 B1 | * | 4/2002 | Ojanen | 299/111 |

* cited by examiner

*Primary Examiner*—Joseph J. Hail, III
*Assistant Examiner*—Shantese McDonald
(74) *Attorney, Agent, or Firm*—Robert L. Marsh

(57) ABSTRACT

A cutting tool has a centrally located tungsten carbide insert brazed into a seat at the forward end of the tool. The seat has a circular mouth and rearward of the mouth is a frustoconical inner wall. At the bottom of the seat is a transverse surface. A tungsten carbide insert is brazed into the seat and the base of the insert is complementary in shape to the seat. A second annular insert may also be brazed into a complementary shaped annular seat that surrounds the centrally located seat.

20 Claims, 4 Drawing Sheets

CUTTING TOOL WITH HARDENED TIP HAVING A TAPERED BASE

Priority is claimed from my copending provisional application filed Dec. 31, 2001 and assigned serial No. 60/345,429.

The present application relates to cutting tools having hardened tungsten carbide tips and, in particular, to a new tip having a tapered base, that is a base having a large forward diameter complementary to the diameter of the mouth of the seat of the tool and a smaller rearward diameter recessed in the seat.

BACKGROUND OF THE INVENTION

Machines used to cut hard surfaces such as asphalt and concrete have a plurality of tools mounted on a wheel or drum which is forced against the surface to be broken. Each tool has an elongate steel body at the forward end of which is a tungsten carbine insert for breaking up the hard surface to be cut. The tools are mounted in tool holders on the wheel or drum such that the tools move through a circular orbit as the wheel rotates with each tip penetrating the hard surface and removing a small amount of material to thereby advance the cut.

As the machine cuts away hard material, the tools become worn. The hardened cutting tip at the forward end of the tool body is gradually eroded away as the tip is repeatedly forced into the hardened material, and behind the cutting tip, the metal tool body is worn away by the movement of particles of hard material around the steel body causing a phenomenon commonly known as "wash away."

In the summer months, especially in the southern states, the steel of tools on machines used to remove the upper surfaces of an asphalt highway can become so eroded by wash away that the forward end of a tool takes on an hourglass contour. An hourglass contour is one which the tool body is narrower at its midsection than it is at either the end mounted in the tool holder or the end holding the cutting insert, such that further use of the tool will soon result in failure.

After the cutting tools of the machine become worn, the machine must be taken out of service and the tools replaced, a process which consumes a considerable amount of time, and it is not uncommon in warmer states to replace the tools of a machine two or three times during the course of a single working day. It is, therefore, desirable to design tools and the inserts of tools so as to maximize their useful life.

A common cause of tool failure is the braze which binds the tungsten carbide insert into the seat at the forward end of the tool body. Although braze material bonds readily to the steel of the tool body, brazing material binds only to the cobalt or nickel which makes up only a small percentage of the tungsten carbide insert. A certain percentage of all tool failures are the result of defects in the braze causing the tungsten carbide insert to fall out of the tool body before either the tool body or the insert has become sufficiently worn to be taken out of service. As a result, the provision of a consistent high quality braze between the tool body and the insert is a necessary element for extending the useful life of a tool.

SUMMARY OF THE INVENTION

Briefly, the present invention is embodied in a tool having an improved cutting tip resulting in the reduction of damage to the tool body by virtue of wash away and a reduction of tool failure as a result of defects in the braze joining the tungsten carbide tip to the tool body. The tool includes a tool body having a longitudinal axis, a tapered cutting portion symmetric abound the axis, a radial flange behind the cutting portion, and a cylindrical shank behind the radial flange. The shank of the cutting tool is sized to be received within a cylindrical tool holder mounted on the machine. The tapered cutting portion of the tool body has a seat at the forward end thereof and brazed into the seat is an insert in accordance with the present invention.

The insert is made of tungsten carbide and has a forward cutting end for cutting a hard surface. Rearward of the forward cutting end is a base portion having an outer surface which is complementary to the inner surface of the seat at the forward end of the tool body. The forward end of the seat is defined by a generally circular mouth rearward of which is a frustoconical inner wall, and rearward of the inner wall is a transverse bottom surface, which may be conical, semi-circular, or any other configuration to define the distal rearward end of the seat. The base of the insert has an outer wall complementarily in shape to the frustoconical inner wall and a rear surface complementary in shape to the transverse bottom surface of the seat. In accordance with the invention, the outer surface of the base of the insert tapers from a relatively large diameter at the forward end thereof to a somewhat smaller diameter at the rearward end.

In one preferred embodiment, an insert in accordance with the present invention has a forward cutting end defining a maximum outer diameter. Rearward of the forward cutting end is an elongate tapered central body which narrows from the maximum outer diameter of the forward cutting end to a smaller diameter defining the rear of a base, and behind the rear diameter is a transverse rear surface. The insert is received in a tapered seat which is symmetrical about a longitudinal axis and is complementary in shape to the rear portion of the tapered outer surface of the insert and to the transverse rear surface.

In another preferred embodiment the tool body has a seat in the forward end and an insert in the seat, the insert and seat being configured as described above with respect to the first embodiment. Surrounding the seat is an annular groove coaxial with the axis of the seat, and brazed into the annular groove is an annular tungsten carbide collar. The annular collar which extends around the base of the cutting insert serves as a shield that protects the tool body from the ravages of wash away and therefor extends the life of the tool. The collar can be of a different hardness than the insert and the braze material used to retain the insert in the seat can have different properties from the braze material used to retain the collar in the annular groove.

There are many benefits to the configuration of an insert having a base in accordance with the present invention. The taper of the outer wall of the base from a large diameter at the mouth of the seat to a smaller diameter rearward of the mouth provides for self centering within the complementary shaped inner wall of the seat. The most expensive portion of such a tool is the insert because tungsten carbide is a very expensive material, and an insert with a body which tapers inwardly toward the rear is less expensive to manufacture than a cylindrical body or one that tapers outwardly toward the rear. The taper also permits the provision of a plurality of protrusions aligned to define a circle around the base of the insert, the circle defined by a plane perpendicular to the axis, for spacing the outer surface of the base from the complementary shaped inner surface of the seat for allowing braze material to flow therebetween. By providing two pluralities of protrusions, each plurality defining a plane perpendicular to the axis of the insert, where the planes are spaced from one another and engage the inner wall of the seat, the insert becomes self centering and self aligning. It should be appreciated that an insert with a cylindrical seat, as is the case with the prior art, cannot be self-aligning and is always somewhat misaligned.

The tapered configuration also permits the burping out of steam and other gases. Small amounts of water permeate the flux needed to properly braze the parts. As the parts are heated to melt the braze, the moisture turns to steam and unless the steam can be released, it forms a pocket between the surfaces of the base and the seat, ejecting the carbide insert from the seat. Where the outer surface of the base is tapered, the steam can push the insert outward of the seat and escape between the outer surface of the base and the inner surface of the seat as a burp. In similar fashion the tapered configuration allows flux and excess braze to escape during the brazing process. The tapered configuration of the base and the seat also allows the tungsten carbide insert to forge of flatten the dings and nicks at the mouth of the seat during one of the final manufacturing steps in which the insert is pneumatically pressed into the metal body that has been heated to forging temperature.

The tapered contour of the inner wall of the seat results in a thicker steel wall at the base of the seat than at the top, thereby providing for a stronger seat for retaining the tungsten carbide insert. Another benefit results from the fact that an oscillating magnetic field generated by an induction heater is used to braze the parts together. During the brazing process a wafer or slug of braze material is placed in the seat of the tool body under the rear surface of the insert, and the parts are then subjected to the oscillating magnetic field of the induction heater. The steel of the tool body is electrically magnetic and, therefore, it is heated by the oscillating magnetic force field. Heat from the steel body melts the wafer of braze material. Except for the cobalt or nickel, which make up only a small portion of the amalgamation of metals within the insert, the tungsten carbide is slightly magnetic and is only slightly heated by the induction heater. Where the wall of the seat has a taper in accordance with the present invention, the wall surrounding the base of the insert is thicker than the walls of all prior art seats and, therefore, it is more readily heated by induction heating. The steel is therefor heated faster and to higher temperatures than was the case during brazing of prior art inserts into their corresponding seats.

Where the insert is surrounded by an annular collar, the seat for the insert and the annular groove for retaining the collar are machined into the forward end of the tool body leaving a tubular protrusion. The inner wall of the tubular protrusion is the inner wall of the seat for retaining the conical insert and the outer wall of the protrusion is the inner wall of the groove for retaining the collar. The steel protrusion therefor separates the tungsten carbide of the insert from the tungsten carbide of the collar. Capillary action for the braze material is better with steel than with tungsten carbide so the steel draws the liquefied braze material between the parts. The braze material also bonds more strongly and more readily to steel than to tungsten carbide and therefor the steel protrusion improves the brazing strength retaining both the insert and the collar.

The quality of the tungsten carbide of which the insert is made is improved by the better compacting of the particles prior to sintering. The frustoconically shaped body of the insert of the present invention results in better powder flow during the manufacture of the insert which causes a more dense compaction of the particles than a cylindrical insert because the tapered walls apply compressive forces at 90 degrees to the walls of the die against the particles while they are being forced into the die. The final product is less subject to breakage than prior art inserts because the steel tubular sleeve, positioned between the inner and outer tungsten carbide portions, provides more resiliency along its entire length adjacent to the insert.

BRIEF DESCRIPTION OF THE DRAWINGS

A better understanding of the present invention will be had after a reading of the following detailed description taken in conjunction with the following drawings wherein.

DETAILED DESCRIPTION OF THE PREFERRED EMBODIMENT

Figure 1:
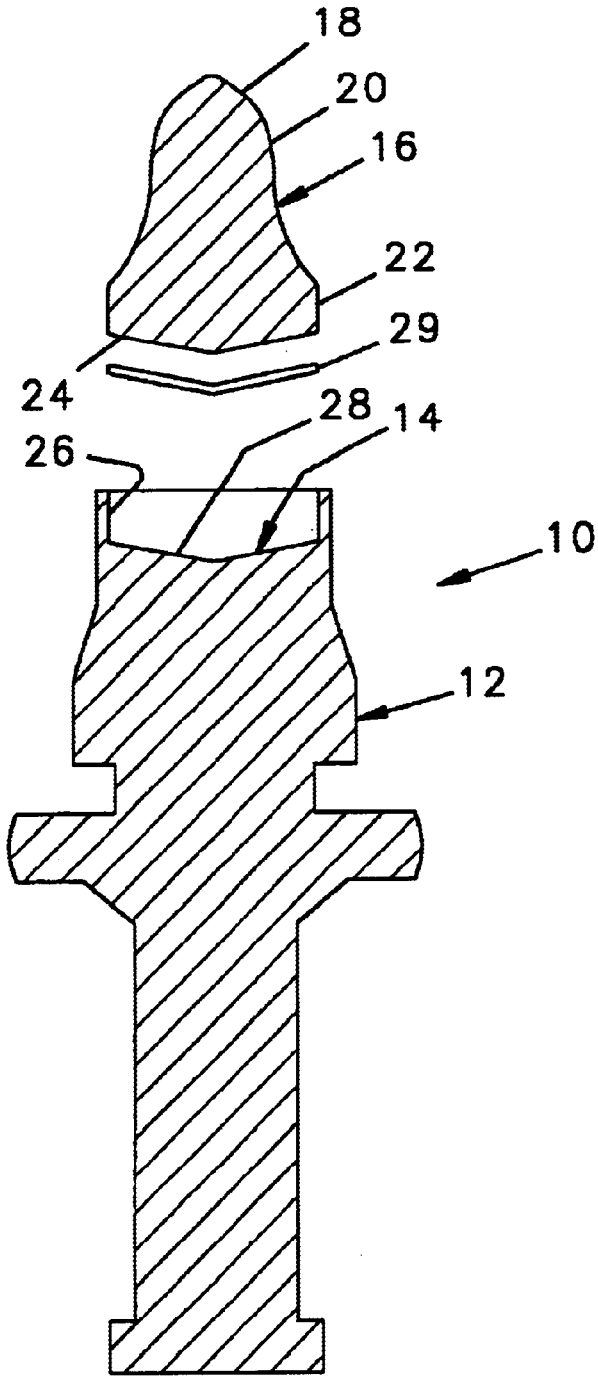
FIG. 1 is an exploded cross sectional view of a tool body having an insert in accordance with the prior art.

Referring to FIG. 1, a tool 10 in accordance with the prior art includes a tool body 12 having a seat 14 at the forward end thereof and an insert 16 brazed into the seat 14. The insert has a conical forward cutting end 18, a tapered midsection 20 and a generally cylindrical base 22 with a conical rear surface 24. The base 22 of the prior art insert 16 is fitted into the complementary shaped seat 14 which in turn has a cylindrical inner wall 26 complementary to the cylindrical base 22 and a bottom surface 28 complementary to the rear surface 24 of the insert 16 and is retained by braze material 29.

Figure 2:
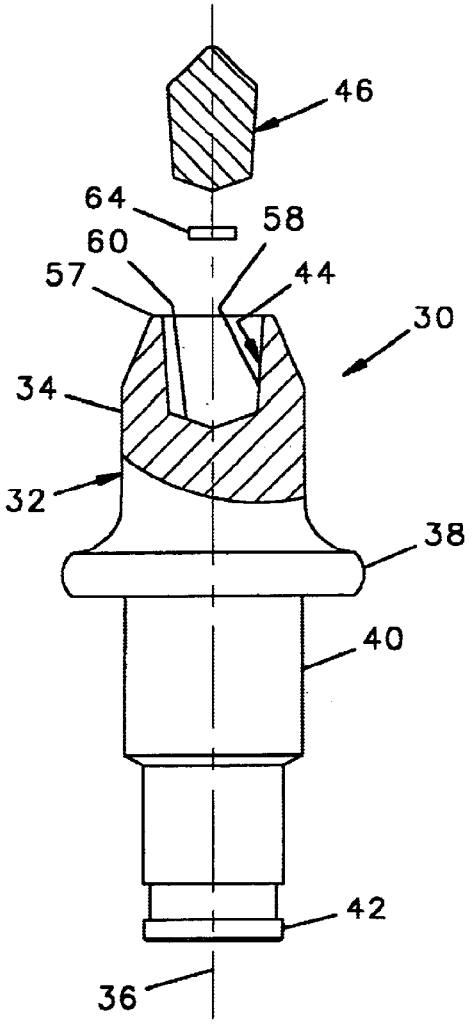
FIG. 2 is an exploded, partially cross sectional, view of a tool body having an insert in accordance to one embodiment of the present invention.
Figure 3:
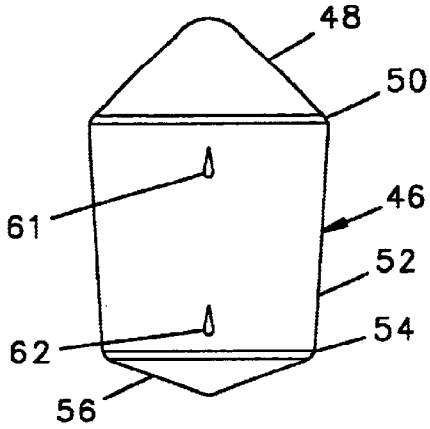
FIG. 3 is an enlarged side elevational view of the insert shown in FIG. 2.
Figure 4:
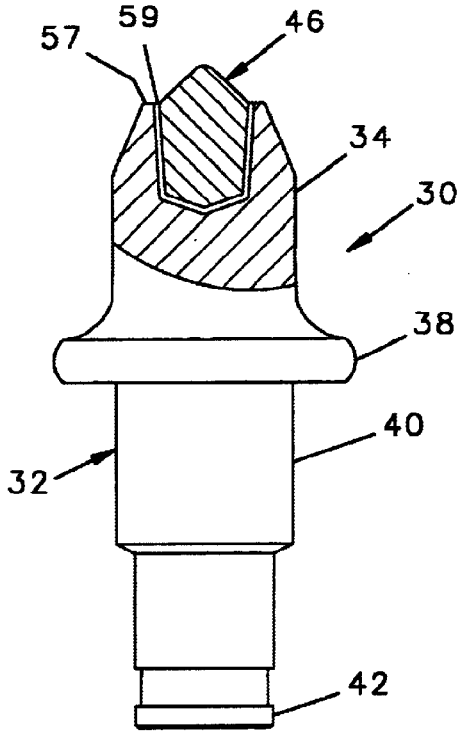
FIG. 4 is a cross sectional view of the tool body and insert as shown in FIG. 2 in assembled relationship.

Referring to FIGS. 2, 3 and 4, a tool 30 in accordance with the present invention has a tool body 32 having a rotationally symmetric forward portion 34 defining an axis 36 and axially aligned behind the forward portion 34 is a radial flange 38. Axially behind the radial flange 38 is a cylindrical shank 40 having a hub 42 at the distal end thereof, the hub 42 having a diameter greater than that of the shank and less than the radial flange.

At the forward end of the tool body 32 is a seat 44 and fitted into the seat 44 is a tungsten carbide insert 46. The insert 46 has a generally conically shaped forward cutting end 48 which defines a maximum outer diameter 50. Rearward of the maximum outer diameter 50 of the cutting end 48 is a generally frustoconcial midsection 52 which extends from the maximum outer diameter 50 to a smaller rear diameter 54, and rearward of the smaller rear diameter 54 is a transverse generally conical end surface 56.

The seat 44 has a mouth 57, an inner wall 58 which is complementary in shape to the rearward portion of the frustoconical midsection 52 of the insert 46, and a conical bottom surface 60 which is complementary in shape to the conical end surface 56 of the insert 46. The inner wall 58 is sized a little larger in diameter than the outer surface of the frustoconical midsection 52 when the rearward end of the insert 46 is fitted into the seat 44 to allow room for braze material 59 to move between the surfaces of the parts and bind them together. Furthermore, a first plurality of circumferencially spaced protrusions 61 and a second plurality of circumferencially spaced protrusions 62 extend around the rearward portion of the frustoconcial midsection 52 of the insert 46 to provide for precision spacing between the parts, and both self centering and self aligning of the insert 46 within the seat 44. Preferably the outer wall of the midsection 52 is spaced from the inner wall 58 of the seat 44, and the conical surfaces 56 and 60 are spaced from each other a distance of about 0.012 inches to allow braze material to flow between the parts.

To assemble the parts shown in FIG. 2 into the configuration shown in FIG. 4, the tool body 32 is oriented with the mouth 57 of the seat 44 opening upwardly and the bottom surface 60 of the seat 44 below the mouth 57 so that gravity will draw the rear end of the insert 46 into the seat 44. The insert 46 is oriented with the conical end surface 56 thereof extending downwardly and the forward cutting end 48 directed upwardly with a disk of braze material 64 positioned in the seat 44 between the bottom surface 60 thereof and the conical end surface 56 of the insert. Flux is applied to the insert 46 prior to the insertion of the insert into the seat.

To melt the disc of braze material 64, an induction heater, not shown, heats the metal of the tool body 52 which in turn heats the disk of braze material 64, the flux, not shown, and the rearward end portion of the insert 46. As the disk of braze material 64 melts, any moisture embedded in the flux material is turned to steam. The steam forces the insert 46 to move upwardly within the inner wall 58 of the seat 44 such that the spacings between the inner wall 58 of the seat 44 and the frustoconical midsection 52 of the insert 46 to become wider and thereby allow bubbles of steam to burp up along the sides thereof. The burping permits trapped water vapor and other gases to escape after which gravity causes the insert 46 to fall back into its prior position with the conical end surface 56 thereof near the bottom surface 60 of the seat 44. The final step in seating the insert employs a pneumatic cylinder, not shown, which forces the insert into the seat 44 until the protrusions 61, 62 are force against the wall 58 of the seat 44.

Referring further to FIG. 3, it should be appreciated that the insert 46 does not have an easily identifiable base such as is the base 22 of the prior art insert 16. For all practical purposes, the base of the insert 46 consists of the rearward one half or more of the frustoconical midsection 54 and the transverse generally conical end surface 56. The base of the insert 46 therefore comprises a portion of the midsection 54 which extends into the inner wall 58 of the seat 44. It should also be appreciated the benefits of the present invention would apply to an insert having any of a number of configurations for the portions thereof which extend forward of the mouth 57 of the seat 44. The forward portion of the insert could be cylindrical or taper at a different angle, or the reverse angle without departing from the invention.

Figure 5:
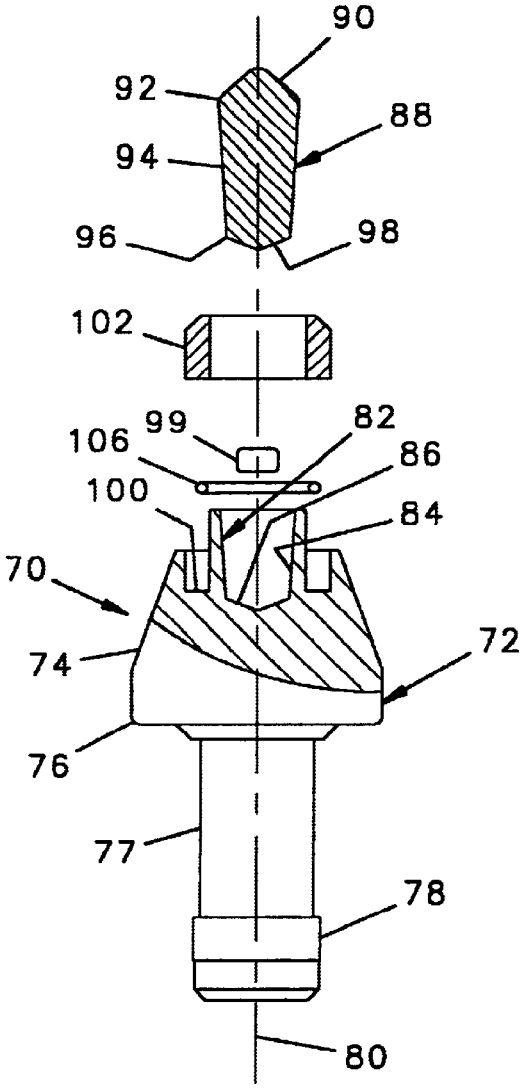
FIG. 5 is a partially cross sectional exploded view of a tool body and insert in accordance with a second embodiment of the invention.
Figure 6:
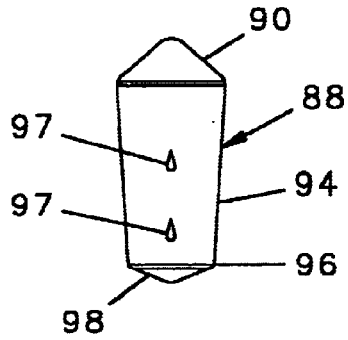
FIG. 6 is a side elevational view of the insert shown in FIG. 5.
Figure 7:
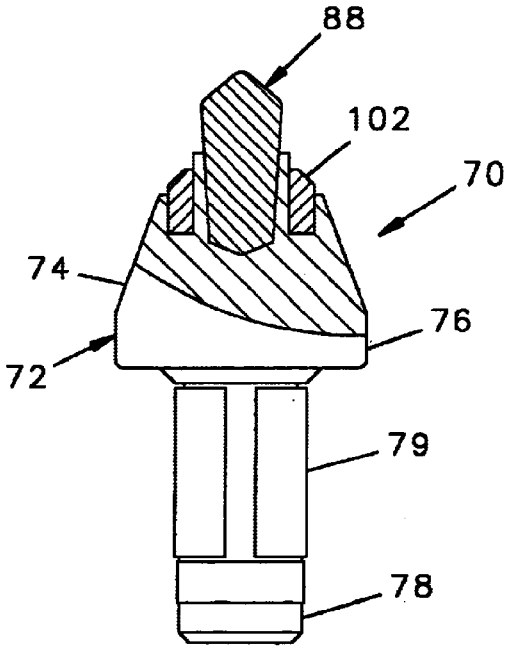
FIG. 7 is a partially cross sectional view of the tool body and insert in assembled relationship after brazing has been completed.

Referring to FIGS. 5, 6 and 7, in a second embodiment a tool 70 in accordance with the present invention has a body 72, a tapered forward portion 74, a radial flange 76 and a shank 77 are all symmetrical about a longitudinal axis 80. An enlarged hub 78 at the distal end of the shank 77 holds a retainer sleeve 79 on the shank 77. At the forward end of the tool body 72 is a seat 82 having a generally frustoconical inner wall 84 and having a conical bottom 86.

Fitted into the seat 82 is an insert 88 having a conical cutting end 90 having a maximum diameter 92, a frustoconical midsection 94 extending from a large diameter forward end at the maximum diameter 92 to a smaller diameter rear end 96 and having a conical rear surface 98. Spaced around the circumference of the midsection 94 of the insert 88 are protrusions 97 to space the insert 88 from the inner wall 84 of the seat 82. Between the bottom 86 of the seat 82 and the rear surface 98 of the insert is a disc of braze material 99.

Extending coaxially with the axis 80 into the forward end of the tool body 72 is an annular outer groove 100 into which is brazed a tubular tungsten carbide collar 102. A ring of braze material 106 is positioned in the groove 100 and under the collar 102, and the disc of braze material 99 and the ring 106 are both melted and allowed to harden to bind the insert 88 into the seat 82 and the collar 102 into the groove 100 respectively. In accordance with the invention, the maximum diameter 92 of the conical cutting end 90 and the annular collar 102 provide a tungsten carbide shield to protect the tapered forward portion 74 of the tool body 72 from being eroded by wash away.

Figure 8:
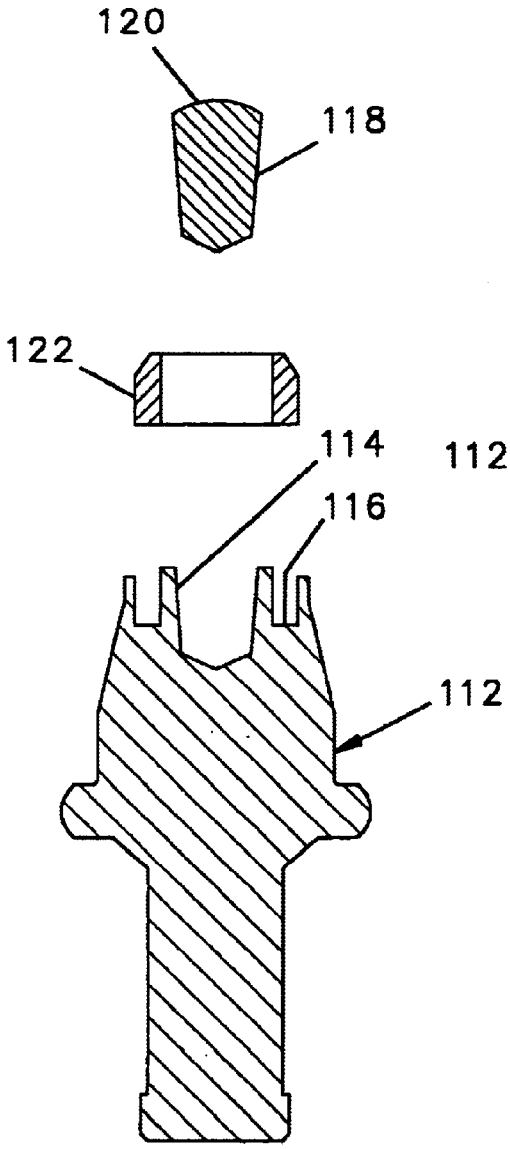
FIG. 8 is an exploded cross sectional view of a tool having an insert in accordance with a third embodiment of the present invention.
Figure 9:
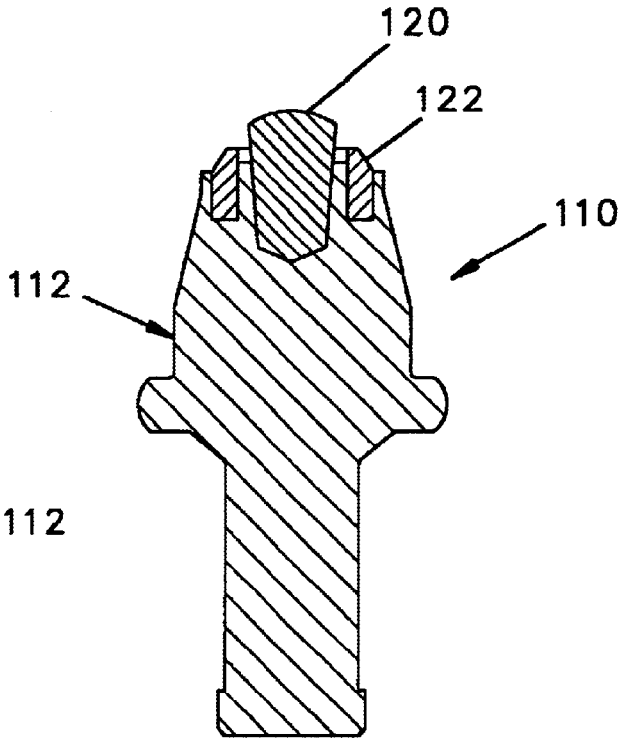
FIG. 9 is an assembled view of the tool body and the insert in accordance with the embodiment shown in FIG. 8.

Referring to FIGS. 8 and 9, in which a tool 110 according to another embodiment is depicted. In this embodiment, the tool body 112 has elements substantially the same as those described with respect to tool 70 including a seat 114 at the forward end thereof and surrounding the seat is an annular groove 116, the seat 114 and groove 116 having elements similar to the seat 82 and groove 100 of the tool body 72. The insert 118 fits into the seat 114 and has a blunted forward end 120 and a collar 122 similar to that described with respect to the tool body 72 and insert 88 described above. The tool 110 with the blunted forward end 120 is suitable for use in snow and ice removal machines to break up ice and compacted snow and the like.

While the present invention has been described with respect to three embodiments, many modifications and variations may be made without departing from the true spirit and scope of the invention. It is, therefore, the intent of the appended claims to cover all such variations and modifications which fall within the spirit and scope of the invention.

What is claimed:

1. A cutting tool comprising a tool body having a longitudinal axis, a tapered cutting portion, a radial flange axially behind said tapered cutting portion and a cylindrical shank behind said radial flange, an insert made of a hardened material, said insert having a forward cutting end and a tapered central body axially behind said forward cutting end, and a rearward end, said central body tapering from a larger forward diameter to a smaller rearward diameter, said tool body having a seat in said forward end of said tapered cutting portion, said seat having a mouth and a tapering inner wall extending rearwardly from said mouth, a portion of said central body extending into said seat and a portion of said central body extending outward of said seat, a portion of said tapered central body of said insert complementary to a portion of said tapering inner wall of said seat, and said rearward end of said insert bonded in said seat of said tool body.

2. A cutting tool in accordance with claim 1 wherein said tapered central body is frustoconical.

3. A cutting tool in accordance with claim 1 wherein said insert has a conical forward cutting end.

4. A cutting tool in accordance with claim 3 wherein said tapered central body is frustoconical.

5. A cutting tool in accordance with claim 4 wherein said conical forward end has a maximum diameter and said maximum diameter of said forward cutting end is at said larger forward diameter of said tapered central body.

6. A cutting tool in accordance with claim 1 and further comprising an annular groove surrounding said seat in said forward end of said tool body, and an annular collar in said groove.

7. A cutting tool in accordance with claim 6 wherein said annual collar is made of tungsten carbide.

8. A cutting tool in accordance with claim 6 wherein said insert is brazed into said seat and said annular collar is brazed into said annular groove.

9. A cutting tool in accordance with claim 8 wherein said braze retaining said insert has different properties from said braze retaining said annular collar.

10. A cutting tool comprising a tool body having a longitudinal axis, a tapered cutting portion, a radial flange axially behind said tapered cutting portion and a cylindrical shank behind said radial flange, said tool body having a seat in said forward end of said tapered cutting portion, said seat having a mouth and a tapering inner wall extending rearwardly from said mouth, an insert made of a hardened material, said insert having a forward cutting end, a tapered central body axially behind said forward cutting end, and a rearward surface rearward of said tapered central body, said tapered central body having a forward portion and a rearward portion, said forward portion of said tapered central body extending outward of said mouth, said seat having an inner surface complementary to said rearward portion of said tapered central body, and said rearward portion of said tapered central body and said rearward surface of said insert bonded into said seat.

11. A cutting tool in accordance with claim 10 wherein said tapered central body is frustoconical with a large diameter forward end and a smaller diameter rearward end.

12. A cutting tool in accordance with claim 10 wherein said insert has a conical forward cutting end.

13. A cutting tool in accordance with claim 12 wherein said tapered central body of said insert is frustoconical with a large diameter forward end and a smaller diameter rearward end.

14. A cutting tool in accordance with claim 13 wherein said conical forward cutting end of said insert has a maximum diameter and said maximum diameter of said forward cutting end is at said large diameter forward end of said tapered central body.

15. A cutting tool in accordance with claim 10 and further comprising an annular groove surrounding said seat in said forward end of said tool body, and an annular collar in said groove.

16. A cutting tool in accordance with claim 15 wherein said annual collar is made of tungsten carbide.

17. A cutting tool in accordance with claim 15 wherein said insert is brazed into said seat and said annular collar is brazed into said annular groove.

18. A cutting tool in accordance with claim 17 wherein said braze retaining said insert has different properties from said braze retaining said annular collar.

19. A cutting tool in accordance with claim 17 wherein said braze retaining said insert has the same properties as the said braze retaining said annular collar.

20. A cutting tool comprising a tool body having a longitudinal axis, a tapered cutting portion, a radial flange axially behind said tapered cutting portion and a cylindrical shank behind said radial flange, an insert made of a hardened material, said insert having a forward cutting end and a base axially behind said forward cutting end, said base having a tapered surface tapering from a larger forward diameter to a smaller rearward diameter, said tool body having a seat in said forward end of said tapered cutting portion, said seat having a mouth and a tapering inner wall extending rearwardly from said mouth complementary to said base of said insert, a first plurality of protrusions spaced around said tapered surface for spacing said tapered surface from said tapering inner wall of said seat, a second plurality of protrusions spaced around said tapered surface for spacing said tapered surface from said tapering inner wall, and all of said first plurality of protrusions nearer said rearward diameter than any of said second plurality of protrusions.

* * * * *